US009038820B2

(12) United States Patent
Ashry

(10) Patent No.: US 9,038,820 B2
(45) Date of Patent: May 26, 2015

(54) FOLDING UTILITY SURFACE WITH BUILT IN CONTAINERS

(71) Applicant: Mohamed Ashry, Cliffside Park, NJ (US)

(72) Inventor: Mohamed Ashry, Cliffside Park, NJ (US)

( * ) Notice: Subject to any disclaimer, the term of this patent is extended or adjusted under 35 U.S.C. 154(b) by 47 days.

(21) Appl. No.: 13/918,853

(22) Filed: Jun. 14, 2013

(65) Prior Publication Data

US 2014/0367282 A1 Dec. 18, 2014

(51) Int. Cl.

| | |
|---|---|
| ***B65D 77/00*** | (2006.01) |
| ***B65D 5/00*** | (2006.01) |
| *A47B 3/083* | (2006.01) |
| *B25H 3/02* | (2006.01) |

(52) U.S. Cl.

CPC ..... *B65D 5/009* (2013.01); *A47B 3/083* (2013.01); *Y10S 312/902* (2013.01); *B25H 3/023* (2013.01)

(58) Field of Classification Search

CPC ..... A47B 3/083; A45C 2007/0004; B65D 25/2867; B65D 79/00; B65D 77/24; B65D 81/36; B65D 85/00; B65D 5/528; Y10S 312/902; B25H 3/023; B42D 15/045

USPC ..... 206/216, 373; 220/520, 522, 836, 840, 220/4.27, 23.6; 229/520

See application file for complete search history.

(56) References Cited

U.S. PATENT DOCUMENTS

| | | | | |
|---|---|---|---|---|
| 695,326 | A * | 3/1902 | Morris | 190/16 |
| 4,951,812 | A * | 8/1990 | Chen | 206/748 |
| 4,998,616 | A * | 3/1991 | Hillinger | 206/748 |
| 6,533,138 | B2 * | 3/2003 | Chwen-Ru | 220/522 |

FOREIGN PATENT DOCUMENTS

GB 2228920 A * 9/1990

* cited by examiner

*Primary Examiner* — Anthony Stashick
*Assistant Examiner* — James M Van Buskirk
(74) *Attorney, Agent, or Firm* — James M. Smedley LLC; James Michael Smedley, Esq.

(57) ABSTRACT

The present invention relates to utility surfaces. Specifically, the invention relates to a utility surface, generally a table or other flat surface, with drawers attached to the utility surface. In preferred embodiments of the present invention, the utility surface and attached drawers may be folded into a collapsed format that is convenient for portability.

20 Claims, 4 Drawing Sheets

FOLDING UTILITY SURFACE WITH BUILT IN CONTAINERS

FIELD OF THE INVENTION

The present invention relates to utility surfaces. Specifically, the invention relates to a utility surface, generally a table or other flat surface, with containers attached to the utility surface. In preferred embodiments of the present invention, the utility surface and attached containers may be folded into a collapsed format that is convenient for portability.

BACKGROUND OF THE INVENTION

Utility surfaces are utilized in numerous fields for various purposes. In general, utility surfaces allow placement of the utility surface onto another surface such that an individual can utilize the utility surface without coming into contact with the surface beneath the utility surface. Examples of utility surfaces include, but are not limited to, baby changing stations, picnic basket with sitting/eating surface, mechanic's pads, toolbox with utility surface, and floor cots.

Frequently, individuals utilizing a utility surface have need of one or more ancillary items to complete the task for which the utility surface is being used. For instance, with respect to a baby changing station, users frequently need a supply of some combination of diaper wipes, diapers, creams, lotions and powers. With respect to mechanic's pads, users frequently need one or more tools (e.g., screwdrivers, wrenches) and pieces of hardware (e.g., nuts, bolts, screws).

Additionally, utility surfaces are frequently used in situations where portability is desirable. For instance, with respect to a baby changing station, parents frequently use such devices during travel, camping or even using the changing station in different locations within the home.

Currently, users of utility surfaces are required to carry a utility surface and ancillary items separately. In many cases, the utility surface may be whatever surface is handy (e.g., tabletop). In some cases, users are forced to carry both the utility surface and ancillary items in a single container (e.g., diaper bag), but even this is inconvenient as the users must still dig through the container in order to find what they need.

Therefore, there is a need in the art for a portable utility surface combined with the ability to conveniently store ancillary items for use with the utility surface. These and other features and advantages of the present invention will be explained and will become obvious to one skilled in the art through the summary of the invention that follows.

SUMMARY OF THE INVENTION

The present invention provides a portable utility surface combined with the ability to conveniently store ancillary items for use with the utility surface. In a preferred embodiment, the portable utility surface is attached to a plurality of containers and may be folded into a collapsed format that is convenient for portability.

According to an embodiment of the present invention, a folding utility surface with built in containers includes: a utility surface comprising one or more utility surface panels and one or more handle panels, wherein said each of said one or more utility surface panels and one or more handle panels are interconnected via one or more foldable joints; and one or more containers connected to one or more of said one or more utility surface panels, wherein said one or more foldable joints allow for said utility surface to be collapsed into a compact format, said compact format being formed from the one or more utility surface panels and one or more handle panels to be folded onto one another such that the utility surface is reduced in surface area and said one or more handle panels are exposed, allowing for an individual to carry the folding utility surface with built in containers via said one or more handle panels.

According to an embodiment of the present invention, the connection between each of said one or more containers and said one or more utility surface panels is via one or more foldable joints.

According to an embodiment of the present invention, one or more handle panels are exposed out of a top portion of said folding utility surface with built in containers when in the compact format.

According to an embodiment of the present invention, one or more of said one or more utility surface panels further comprises one or more handle slots.

According to an embodiment of the present invention, each handle slot aligns with a handle slot formed in each of said one or more handle panels.

According to an embodiment of the present invention, the aligned handle slots allow for the individual to use the handle slots to carry the folding utility surface when the folding utility surface is in the compact format.

According to an embodiment of the present invention, each container of said one or more containers has at least one opening.

According to an embodiment of the present invention, each of said at least one opening is accessible when the folding utility surface is in the compact format.

According to an embodiment of the present invention, a folding utility surface with built in containers includes: a utility surface comprising a first surface panel, a second surface panel, a first handle panel and a second handle panel, wherein said first surface panel and second surface panel are connected via a surface panel foldable joint, said first handle panel is connected to said first surface panel via a first handle foldable joint and said second handle panel is connected to said second surface panel via a second handle foldable joint; and a plurality of containers connected to said utility surface, wherein at least one of said plurality of containers is attached to a side of said first surface panel and at least one of said plurality of containers is connected to a side of said first handle panel, wherein at least one of said plurality of containers is attached to a side of said second surface panel and at least one of said plurality of containers is connected to a side of said second handle panel, wherein said first handle panel is capable of being folded over at least a portion of said first surface panel, said second handle panel is capable of being folded over at least a portion of said second surface panel and a bottom side of said first surface panel being capable of folding against a bottom side of said second surface panel such that the utility surface is reduced in surface area and said first and second handle panels are exposed, allowing for an individual to carry the folding utility surface with built in containers via said one or more handle panels.

According to an embodiment of the present invention, the handle slot of said first surface panel aligns with a handle slot formed in said first handle panel and the handle slot of said second surface panel aligns with a handle slot formed in said second handle panel.

According to an embodiment of the present invention, the aligned handle slots allow for the individual to use the handle slots to carry the folding utility surface when the folding utility surface is in the compact format.

According to an embodiment of the present invention, each container of said plurality of containers has at least one opening.

According to an embodiment of the present invention, each of said at least one opening is accessible when the folding utility surface is in the compact format.

According to an embodiment of the present invention, a folding utility surface with built in containers includes: a utility surface comprising a plurality of utility surface panels and a plurality of handle panels, wherein said each of said plurality of utility surface panels and plurality handle panels are interconnected via a plurality of foldable joints; and a plurality of containers connected to said utility surface, wherein at least one of said plurality of containers is attached to a first side of said utility surface and at least one of said plurality of containers is connected to a second side of said utility surface, wherein said plurality of foldable joints allow for said utility surface to be collapsed into a compact format, said compact format being formed from the one or more utility surface panels and one or more handle panels to be folded onto one another such that the utility surface is reduced in surface area, each container of said plurality of containers is abutted to at least one other container of said plurality of containers, and said one or more handle panels are exposed above said plurality of containers, allowing for an individual to carry the folding utility surface with built in containers via said one or more handle panels.

According to an embodiment of the present invention, the connection between each of said plurality containers and said plurality of utility surface panels is via one or more foldable joints.

According to an embodiment of the present invention, the plurality of handle panels are exposed out of a top portion of said folding utility surface with built in containers when in the compact format.

According to an embodiment of the present invention, one or more of said plurality of utility surface panels further comprises one or more handle slots.

According to an embodiment of the present invention, each handle slot aligns with a handle slot formed in each of said plurality of handle panels.

According to an embodiment of the present invention, the aligned handle slots allow for the individual to use the handle slots to carry the folding utility surface when the folding utility surface is in the compact format.

According to an embodiment of the present invention, each container of said plurality of containers has at least one opening.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED DESCRIPTION OF THE INVENTION

Figure 1:
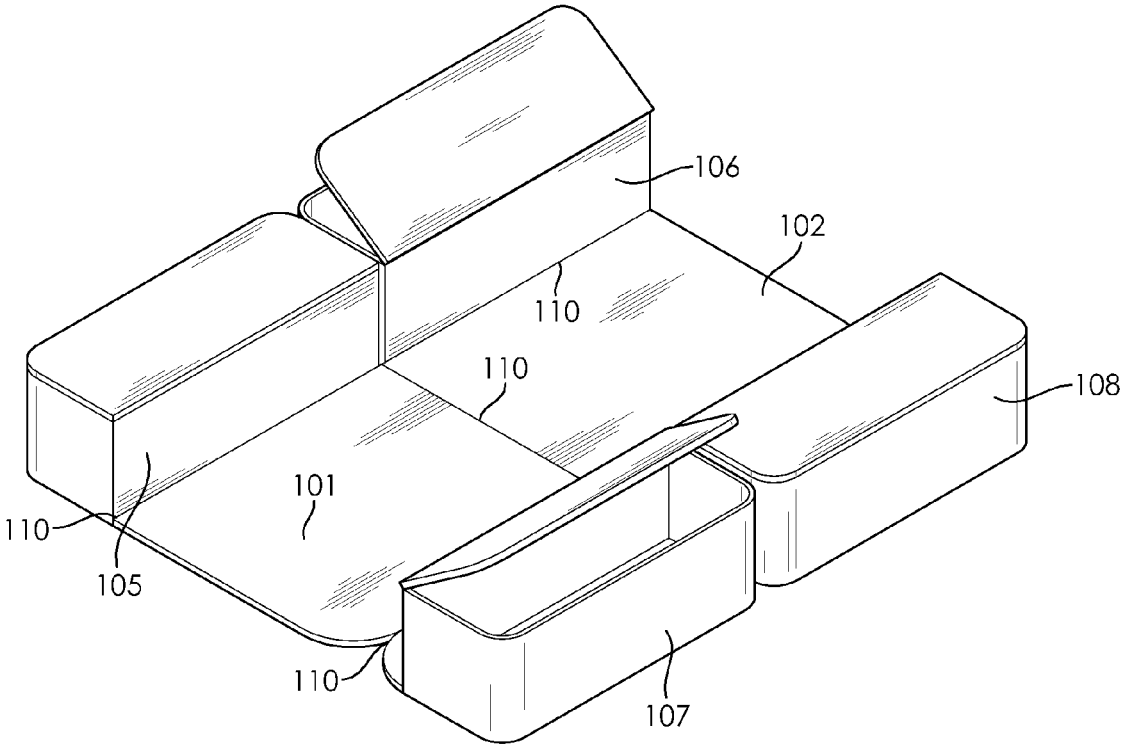
FIG. 1 is a perspective view of a folding utility surface with built in containers, in an expanded format, in accordance with an embodiment of the present invention.

The present invention relates to utility surfaces. Specifically, the invention relates to a utility surface, generally a table or other flat surface, with containers attached to the utility surface. In preferred embodiments of the present invention, the utility surface and attached containers may be folded into a compact format that is convenient for portability.

According to an embodiment of the present invention, the folding utility surface is comprised of a utility surface and one or more attached containers. The utility surface is further comprised of one or more panels that are collapsible such that the utility surface can fold upon itself and provide a compact format whereby the containers are abutting one another, save for the collapsed utility surface between one or more of the containers.

Further, in this compact format, handle panels, which form part of the utility surface in an expanded format of the apparatus, are exposed and allow for an individual to use the handle panels to carry the apparatus. In preferred embodiments, handle panels are generally smaller than the utility surface panels and are comprised of a cutout configured to allow an individual to use the cutout as a handle when the apparatus is in a compact format. In preferred embodiments, the utility surface panels will have matching cutouts for use as a handle that align with the cutouts of the handle panels when the apparatus is in a compact format.

According to an embodiment of the present invention, in certain embodiments, the panels of the utility surface may also have a handle portion, formed from a cut-out in the utility surface panel, such that when the apparatus is moved into a compact format, a hand of an individual can be passed through the handle portion of the utility surface panel and the handle panels as each of the handle components (i.e., handle portion of the surface panel and handle portion of the handle panel.

According to embodiments of the present invention, the panels, both handle panels and utility surface panels, may be constructed from a material appropriate for the general purpose of the apparatus. For instance, where the apparatus is to be used as a baby changing station, a lightweight material that is easily cleanable may be utilized, such as lightweight plastics, semi-rigid foams, wood and lightweight metals. In another example, the apparatus may be used as a picnic basket, where the utility surface provides a seating area and the containers may configured to store foodstuffs. In this configuration, it would be important for the utility surface to be of a material strong enough to allow the apparatus to be carried without failure of the utility panels when the containers are full of foodstuffs. One of ordinary skill in the art would appreciate that there are numerous materials that could be utilized with embodiments of the present invention, and embodiments of the present invention are contemplated for use with any appropriate construction materials.

In a preferred embodiment, in an expanded state, the utility surface is configured to allow usage of the utility surface for the intended purpose (e.g., picnic blanket, infant changing table, mechanic pad). In many cases, the utility surface protects users from dirt, debris or other material that may be underneath the utility surface. The size and format of the utility surface depends largely on its purpose. For instance, a relatively small utility surface may be needed where the apparatus is being used as a baby changing station, while a much larger utility surface may be needed if the utility surface is being used as a mechanic's blanket. One of ordinary skill in the art would appreciate that there are numerous sizes of utility surfaces that could be utilized, and embodiments of the present invention are contemplated for use with any size of utility surface.

According to an embodiment of the present invention, each of the containers are connected to the utility surface and are configured to retain various items, depending on the usage of the utility surface. For instance, where the apparatus is configured for use as a baby changing station, the containers may be configured to retain appropriate items (e.g., diapers, diaper cream, baby powder, baby lotion, diaper wipes). In another example, where the apparatus is configured for use as a mechanic's blanket, the containers may be configured to retain various tools and hardware (e.g., screwdriver sets, ratchet sets, nuts, bolts, screws).

In preferred embodiments of the present invention, the containers are configured to allow access to the contents of the container whether the apparatus is in an expanded format or a compact format. This is achieved through the manner in which the components of the utility surface are folded and will be explained in detail below. In these preferred embodiments, the containers may open from the top of the container. In other embodiments, the containers may open from any side of the container as may be appropriate for the particular purpose of the container and apparatus.

In certain embodiments, the containers may be further comprised of one or more dividers, allowing each container to be divided into two or more separate compartments. This is useful where there are numerous types of items to be stored in the containers and provides flexibility and the ability to organize the containers properly. In certain embodiments, the containers may be provided with multiple divider slots, allowing for receipt of divider panels, which are configured to allow the individual user to insert and remove the divider panels such that the container can have a variable number of separated compartments, as required by the individual user. In certain embodiments the container may be constructed without any divider panels, divider slots or separated compartments. Any number of divider slots and divider panels may be utilized and embodiments of the present invention are contemplated for use with any number of divider panels.

In certain embodiments, the containers may be configured for specific purposes. For instance, a container may be constructed from an insulated material and be utilized as a cooler or thermos for keeping food and/or beverages within a desired temperature range. Certain embodiments may include containers with a power source and a light source, allowing the container to be illuminated, making it easier for a user to find ancillary items within the container. One of ordinary skill in the art would appreciate that there are numerous types of specialized containers that could be used with embodiments of the present invention, and embodiments of the present invention are contemplated for use with any type of container.

It should also be understood that embodiments of the present invention could utilize different types of containers in a single apparatus. For instance, an apparatus may be comprised of four containers, two cooler containers and two standard containers. In this embodiment, two of the containers could be used for foodstuffs while the other two could be utilized for items not requiring insulation (e.g., cutlery, dishware, napkins). One of ordinary skill in the art would appreciate that there are numerous combinations of containers that could be utilized with embodiments of the present invention, and embodiments of the present invention are contemplated for use with any type of container combination.

According to an embodiment of the present invention, the containers may be further comprised of a locking means. The locking means are configured to keep the lids of the containers in a closed position when not in use. Locking means may include, but are not limited to, hook and latches, tie points, magnets, hook and loop fasteners, snaps, combination locks, tumbler locks, or any combination thereof. One of ordinary skill in the art would appreciate that there are numerous types of locking means that could be utilized with embodiments of the present invention, and embodiments of the present invention are contemplated for use with any type of locking means.

According to an embodiment of the present invention, the apparatus may further be comprised of an apparatus locking means. The apparatus locking means are configured to retain the apparatus in a compact state when placed in such a format. Apparatus locking means may include, but are not limited to, hook and latches, tie points, magnets, hook and loop fasteners, snaps, combination locks, tumbler locks, or any combination thereof. One of ordinary skill in the art would appreciate that there are numerous types of apparatus locking means that could be utilized with embodiments of the present invention, and embodiments of the present invention are contemplated for use with any type of apparatus locking means.

According to an embodiment of the present invention, connection between the various components of the apparatus (e.g., utility surface panels, handle panels, containers) may be by way of one or more foldable joints 110. Foldable joints may include, but are not limited to, hinges, fabric joints, foldable flanks, or any combination thereof. One of ordinary skill in the art would appreciate that there are numerous types of foldable joints that could be utilized with embodiments of the present invention, and embodiments of the present invention are contemplated for use with any type of foldable joint.

In a preferred embodiment of the present invention, the foldable joints 110 allow for the apparatus to move through a series of folding steps, converting the apparatus from the expanded format to the compact format. The progression is clearly shown in FIGS. 1-5.

In a preferred embodiment, the utility surface has containers on at least two opposing sides. Advantageously, this creates a safe area between the containers. In certain formats, such as a baby changing station, this has the additional advantage of keeping an individual who is on the utility surface from rolling in either direction, while the proximity of the containers makes it convenient for accessing and utilizing the materials in those containers.

Exemplary Embodiments

Turning now to FIG. 1, a perspective view of a folding utility surface with built in containers, in an expanded format, in accordance with an embodiment of the present invention, is shown. In this embodiment, a utility surface is shown, comprised of two utility surface panels (101, 102) connected via a folding joint (110), two handle panels (not visible in FIG. 1, but present in other FIGS. 103, 104) and four containers (105, 106, 107, 108) that flank the sides of the utility surface panels (101, 102) via a folding joint (110), leaving one edge of each of the utility surface panels (101, 102) open and free from of any obstruction. In FIG. 1, the utility surface is expanded fully open.

Figure 2:
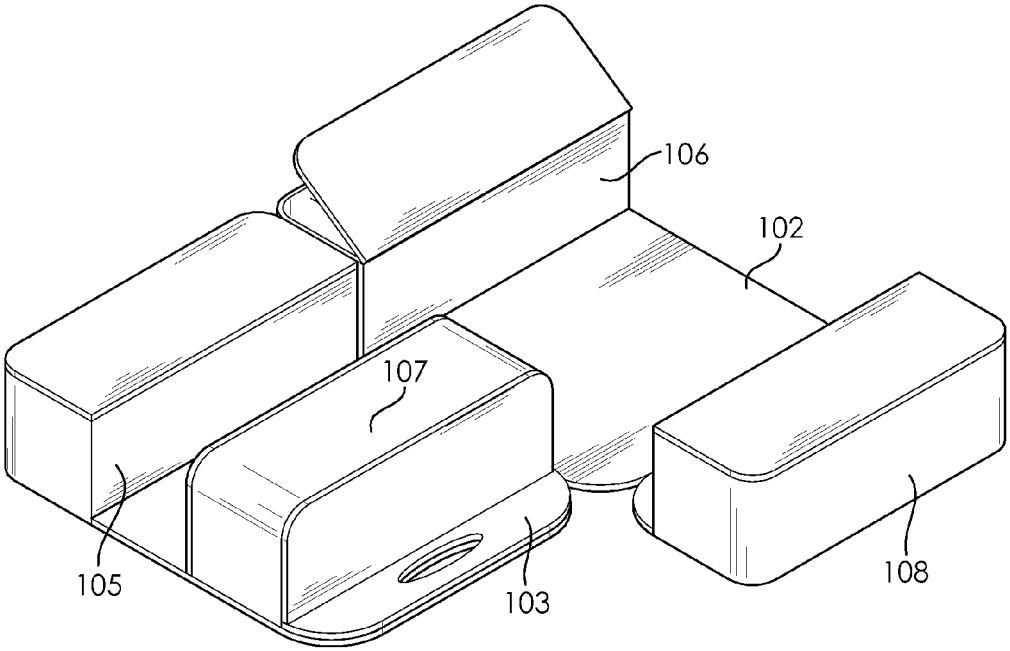
FIG. 2 is a perspective view of a folding utility surface with built in containers in accordance with an embodiment of the present invention.

Turning now to FIG. 2, a perspective view of a folding utility surface with built in containers in accordance with an embodiment of the present invention, is shown. FIG. 2 shows the first step in moving the apparatus from an expanded format to a compact format. In this first step, containers (107, 108) attached to the handle panels (103, 104) of the utility surface are folded over onto a top surface of the utility surface panels.

Figure 3:
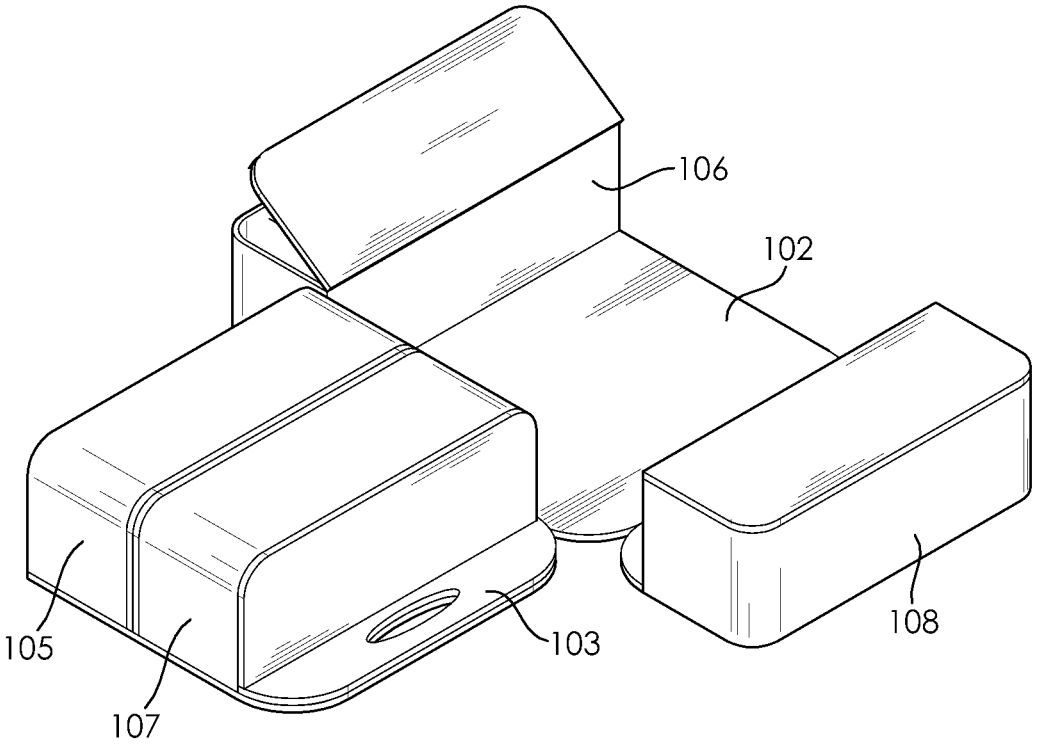
FIG. 3 is a perspective view of a folding utility surface with built in containers in accordance with an embodiment of the present invention.

Turning now to FIG. 3, a perspective view of a folding utility surface with built in containers in accordance with an embodiment of the present invention, is shown. FIG. 3 shows a second step in moving the apparatus from an expanded format to a compact format. In this second step, containers (105, 106) attached to the utility surface panels (101, 102) of the utility surface are folded over onto a top surface of the utility surface panels (101, 102), ideally being abutted to the other containers (107, 108).

Figure 4:
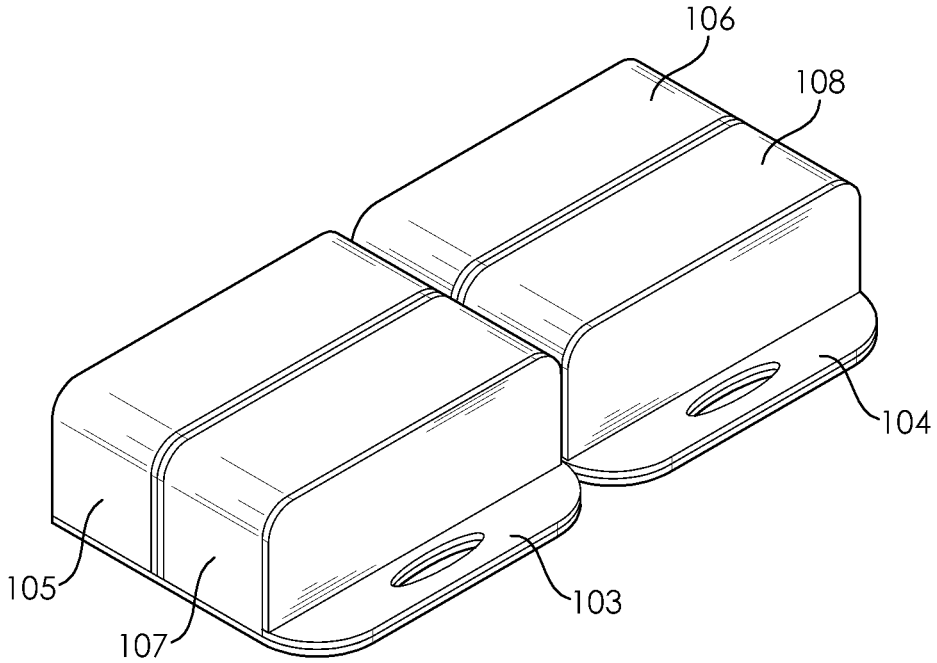
FIG. 4 a perspective view of a folding utility surface with built in containers in accordance with an embodiment of the present invention.

Turning now to FIG. 4, a perspective view of a folding utility surface with built in containers in accordance with an embodiment of the present invention, is shown. FIG. 4 shows a third step in moving the apparatus from an expanded format to a compact format. In this third step, all the containers (105, 106, 107, 108) are folded over onto a top surface of the utility surface panels (101, 102), all the containers being abutted to the other containers (105, 106, 107, 108) and handle panels (103, 104) are extended above the apparatus.

Figure 5:
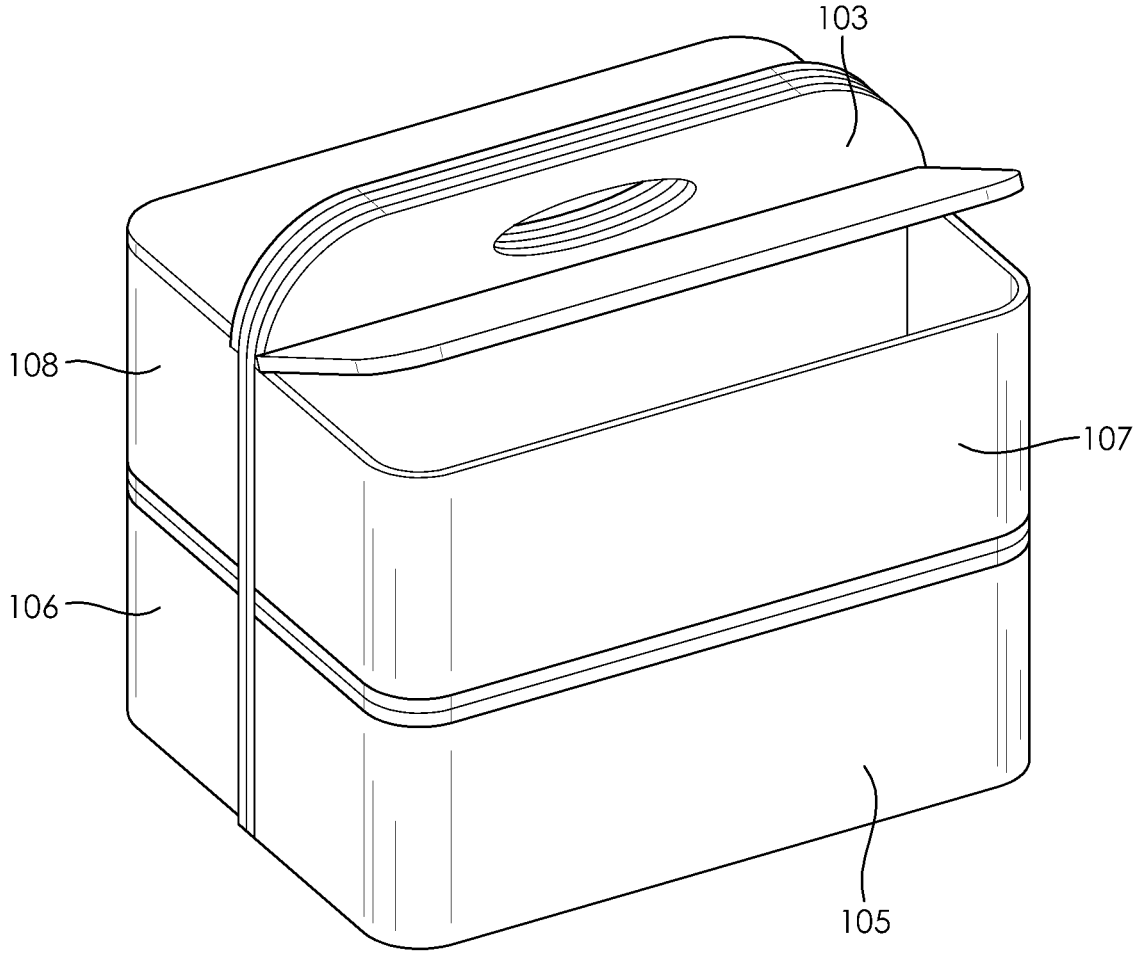
FIG. 5 a perspective view of a folding utility surface with built in containers, in a compact format, accordance with an embodiment of the present invention.
Figure 6:
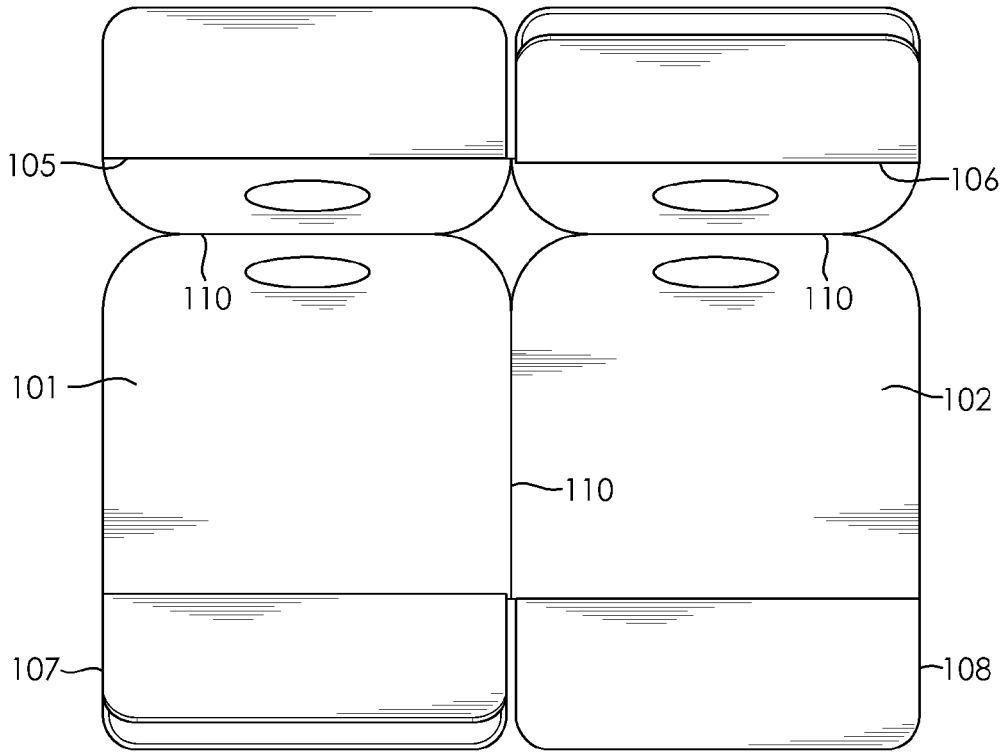
FIG. 6 a top view of a folding utility surface with built in containers, in an expanded format, accordance with an embodiment of the present invention.
Figure 7:
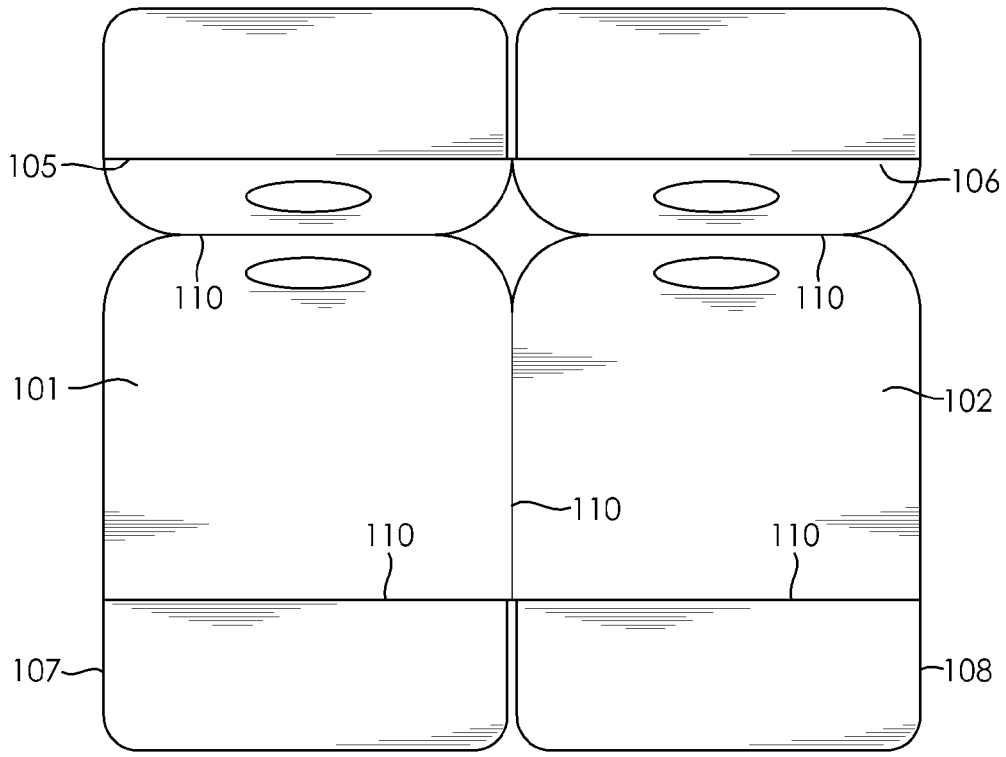
FIG. 7 a bottom view of a folding utility surface with built in containers, in an expanded format, accordance with an embodiment of the present invention.

Turning now to FIG. 5, a perspective view of a folding utility surface with built in containers in accordance with an embodiment of the present invention, is shown. FIG. 5 shows a final step in moving the apparatus from an expanded format to a compact format. In this final step, all the containers (105, 106, 107, 108) are folded together with the handle panels (103, 104) being extended upward and allowing for an individual to conveniently carry the apparatus. It should be noted that in these preferred embodiments, access to the containers is still possible.

While FIGS. 1-5 show a folding utility surface with built in containers comprising 4 containers and two utility surface panels, alternative embodiments may have fewer or greater number of containers, utility surface panels and handle panels. One of ordinary skill in the art would appreciate that embodiments of the present invention could be utilized with any number of such components, and embodiments of the present invention are contemplated for use with any number of components.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A folding utility surface with built in containers, comprising:

one or more utility surface panels and one or more handle panels, wherein each of said handle panels define a handle slot, wherein each of said utility surface panels and handle panels are interconnected via one or more foldable joints; and one or more containers connected to said utility surface panels, wherein said containers flank said utility surface panels on opposite sides thereof leaving the other sides open, thus defining a flat work space that is open on at least two sides when the folding utility surface is in an expanded format, wherein said foldable joints allow for said utility surface to be collapsed into a compact format, said compact format being formed from the one or more utility surface panels and one or more handle panels to be folded onto one another such that the utility surface is reduced in surface area, said one or more handle panels are exposed, and said handle slots are aligned to form a handle, thus allowing an individual to carry the folding utility surface with built in containers by grasping said handle.

2. The folding utility surface of claim 1, wherein the connection between each of said one or more containers and said one or more utility surface panels is via one or more foldable joints.

3. The folding utility surface of claim 1, wherein said one or more handle panels are exposed out of a top portion of said folding utility surface with built in containers when in the compact format.

4. The folding utility surface of claim 1, wherein one or more of said one or more utility surface panels are formed with one or more handle slots.

5. The folding utility surface of claim 4, wherein each handle slot aligns with a handle slot formed in each of said one or more handle panels.

6. The folding utility surface of claim 5, wherein the aligned handle slots allow for the individual to use the handle slots to carry the folding utility surface when the folding utility surface is in the compact format.

7. The folding utility surface of claim 1, wherein each container of said one or more containers has at least one opening.

8. The folding utility surface of claim 7, wherein at least one opening is accessible when the folding utility surface is in the compact format.

9. A folding utility surface with built in containers, comprising:

a first surface panel, a second surface panel, a first handle panel and a second handle panel, wherein each of said surface panels and each of said handle panels are formed with a handle slot, wherein said first surface panel and second surface panel are connected via a surface panel foldable joint, said first handle panel is connected to said first surface panel via a first handle foldable joint and said second handle panel is connected to said second surface panel via a second handle foldable joint; and a plurality of containers connected to said utility surface, wherein at least one of said plurality of containers is attached to a side of said first surface panel and at least one of said plurality of containers is connected to a side of said first handle panel, wherein at least one of said plurality of containers is attached to a side of said second surface panel and at least one of said plurality of containers is connected to a side of said second handle panel, wherein said containers flank said utility surface panels on opposite sides thereof leaving the other sides open, thus defining a flat work space that is open on at least two sides when the folding utility surface is in an expanded format, wherein said first handle panel is capable of being folded over at least a portion of said first surface panel, said second handle panel is capable of being folded over at least a portion of said second surface panel and a bottom side of said first surface panel being capable of folding against a bottom side of said second surface panel such that the utility surface is reduced in surface area, said first and second handle panels are exposed, and said handle slots are aligned thereby forming a handle, allowing for an individual to carry the folding utility surface with built in containers by grasping said handle.

10. The folding utility surface of claim 9, wherein the handle slot of said first surface panel aligns with a handle slot formed in said first handle panel and the handle slot of said second surface panel aligns with a handle slot formed in said second handle panel.

11. The folding utility surface of claim 10, wherein the aligned handle slots allow for the individual to use the handle slots to carry the folding utility surface when the folding utility surface is in the compact format.

12. The folding utility surface of claim 10, wherein each container of said plurality of containers has at least one opening.

13. The folding utility surface of claim 11, wherein at least one opening is accessible when the folding utility surface is in the compact format.

14. The folding utility surface of claim 10, wherein each container of said plurality of containers has at least one opening.

15. A folding utility surface with built in containers, comprising:

a plurality of utility surface panels and a plurality of handle panels, each of said handle panels defining a handle slot, wherein each of said plurality of utility surface panels and plurality handle panels are interconnected via a plurality of foldable joints; and a plurality of containers connected to said utility surface, each of said containers having opposite side openings, wherein at least one of said plurality of containers is attached to a first side of said utility surface and at least one of said plurality of containers is connected to a second side of said utility surface, wherein said plurality of containers flank said utility surface on opposite sides thereof leaving the other sides open, thus defining a flat work space that is open on at least two sides when the folding utility surface is in an expanded format, wherein said plurality of foldable joints allow for said utility surface to be collapsed into a compact format, said compact format being formed from the one or more utility surface panels and one or more handle panels to be folded onto one another such that the utility surface is reduced in surface area, each container of said plurality of containers is abutted to at least one other container of said plurality of containers, said one or more handle panels are exposed above said plurality of containers, and said handle slots are in alignment thereby forming a handle, thus allowing for an individual to carry the folding utility surface with built in containers by grasping said handle, wherein the inside of each container is accessible via one of said opposite side openings in either the compact or expand format.

16. The folding utility surface of claim 15, wherein the connection between each of said plurality containers and said plurality of utility surface panels is via one or more foldable joints.

17. The folding utility surface of claim 15, wherein said plurality of handle panels are exposed out of a top portion of said folding utility surface with built in containers when in the compact format.

18. The folding utility surface of claim 15, wherein one or more of said plurality of utility surface panels are formed with one or more handle slots.

19. The folding utility surface of claim 18, wherein each handle slot aligns with a handle slot formed in each of said plurality of handle panels.

20. The folding utility surface of claim 19, wherein the aligned handle slots allow for the individual to use the handle slots to carry the folding utility surface when the folding utility surface is in the compact format.

* * * * *